United States Patent [19]

Reiter

[11] Patent Number: 4,945,611

[45] Date of Patent: Aug. 7, 1990

[54] COMBING MACHINE

[76] Inventor: Gerhard Reiter, Narzissenstrasse 21, D-4006 Erkrath, Fed. Rep. of Germany

[21] Appl. No.: 406,384

[22] Filed: Aug. 29, 1989

[30] Foreign Application Priority Data

Sep. 12, 1988 [DE] Fed. Rep. of Germany ..... 3831020

[51] Int. Cl.[5] ..... D01G 19/00; D01G 19/16

[52] U.S. Cl. ..... 19/234; 19/223; 19/225; 19/235

[58] Field of Search ..... 19/234, 235, 223, 225

[56] References Cited

U.S. PATENT DOCUMENTS

| | | | |
|---|---|---|---|
| 1,446,750 | 2/1923 | Jolly | 19/223 |
| 1,473,197 | 11/1923 | Nasmith | 19/235 X |
| 1,605,135 | 11/1926 | Nasmith | 19/235 X |
| 2,125,360 | 8/1938 | Schmitt | 19/235 |
| 2,781,556 | 2/1957 | Foster | 19/234 X |
| 3,922,757 | 12/1975 | Horiuchi et al. | 19/234 |

FOREIGN PATENT DOCUMENTS

| | | |
|---|---|---|
| 1161185 | 3/1958 | Fed. Rep. of Germany . |
| 2845245 | 10/1978 | Fed. Rep. of Germany . |
| 2940366 | 10/1979 | Fed. Rep. of Germany . |

*Primary Examiner*—Werner H. Schroeder
*Assistant Examiner*—Ismael Izaguirre
*Attorney, Agent, or Firm*—Browdy & Neimark

[57] ABSTRACT

In a combing machine, in particular for combing of cotton, having a combing roller with at least one combing segment, conveying devices for the fiber tuft to be combed, and an upper and lower nipper for fixing the fiber tuft during the engagement of the combing segment, where the upper and/or lower nippers are seated pivotable in a forward and backward direction on an axis located above the comb cylinder, it has been provided, in order to attain a high operating speed while reducing the transfer paths and the mass to be moved, to derive the drive for the pivot movement of the upper and/or lower nippers directly from the drive for the combing roller by means of a cam drive.

4 Claims, 4 Drawing Sheets

IV
IV
22
60
61
63
66
65
26'
25'
64

60
61
22
62
66
26'
25'
54
65

COMBING MACHINE

BACKGROUND OF THE INVENTION

1. Field of the Invention

The invention relates to a combing machine in particular for combing of cotton, having a combing roller with at least one combing segment, and conveyance means for the fiber tuft to be combed and an upper and a lower nipper for fixing the fiber tuft during engagement of the combing segment, the upper and/or lower nipper being pivotably disposed in a forward and backward direction around an axis disposed above the comb cylinder.

2. The Prior Art

A structure having such a pendulous nipper arrangement is designated as a structure according to Nasmith. Such a structure is covered, for example, in German Patent DE-PS 11 61 185.

Regardless of this particular construction, customary combing machines are normally designed in such a way that the part of the machine which conveys the fiber tuft is moved back and forth in order to make possible in an alternating manner the cyclic engagement of the combing segment and following that, the conveying or removing of the fiber tuft. Because of this back and forth movment of a comparatively large mass, the operating speed of the combing machine is considerably limited.

In connection with wool combing machines, it is already known to pivotably dispose the combing machine head, however, it is necessary to move the draw-off rollers back and forth, because the pivot bearing point of the combing machine head is located relatively far inside the area of the conveying device and therefore the draw-off rollers must be moved out of the way for reasons of space when the combing segment is intended to engage the fiber tuft.

From U.S. Pat. No. 3,922,757 an eccentric disposition of the combing segment is known in order to achieve the desired engagement geometry. However, the combing head with the nipper arrangement is moved back and forth in the customary manner.

From German Published, Non-examined Patent Application DE-OS 28 45 245 a combing machine is known having fixed draw-off rollers, but with back and forth movement of the nipper. In this reference, the problem is already pointed out that the efficiency of customary combing machines is limited because of the oscillation created by the intermittent operation, the size of which considerably depends on the mass acceleration forces of the pendulously moved nipper. To solve this problem a second drive crank for the lower nipper plate is proposed there.

From German Published, Non-examined Patent Application DE-OS 29 40 366 a flat combing machine with a nipper arrangement driven by a linkage is known, which is fastened on a suspended pendulum, the pivot bearing point of which is disposed slightly ahead of the rotating point of the combing segment between it and the draw-off rollers.

SUMMARY OF THE INVENTION

Based on this, it is an object of the invention to design the drive for the upper and lower nippers in such a way that it can be realized by foregoing, to the greatest extent possible, the back and forth movement of masses, it being intended to attain such kinematics of movement that it is possible to utilize fixed draw-off rollers and a structurally simple conveying device. It is intended to attain high operating speeds by minimizing the moved mass and the synchronization effort, at the same time realizing structural simplicity.

This object is attained by means of the invention in that the drive for the pivot movement of the upper and/or lower nippers is directly derived from the combing roller by way of a cam drive.

This results in a transfer of the rotating movement or a transformation of this movement into the opening and closing movements of the nipper arrangement without an extensive drive train while minimizing the mass to be moved.

It is provided in an advantageous manner that the cam drive comprises a cam disk and a spring-loaded pivot lever which supports a rotatably disposed feeler wheel. In an advantageous manner, the cam disk is disposed on the shaft which supports the combing roller. By means of this a very compact construction can be realized which allows transfer paths which are short and entail small losses.

The free end of the pivot lever can engage the lower nipper carrier, which is pivotably disposed around an axis ahead of and above the rotational axis of the combing roller. Such a pivot position is known per se from the state of the art. However, the take-off and transfer of the drive force for the pivot movement of the lower nipper carrier is novel.

In accordance with a further characteristic of the invention, the upper nipper is advantageously fixed on an upper nipper carrier which is pivotably disposed on a pivot bearing located on the lower nipper carrier. In an advantageous manner a guide dog is connected with the upper nipper carrier which is guided by means of a cam guide. By means of this geometry it is achieved that with one pivot movement, which is transferred via the pivot lever to the lower nipper carrier, also a coordinated, relative pivot movement of the upper nipper carrier together with the lower nipper carrier and simultaneously in relation to it is performed, so that because of this a pendulous back and forth movement of the nipper arrangement and simultaneously a closing movement of the same is achieved. This construction thus makes it possible to support the draw-off rollers fixedly and yet to assure safe drawing-off of the fiber tuft, while a problem-free engagment of the combing segment is possible in the combing phase. By means of the cam guidance of the guide dog provided, it is possible to realize a specific relative movement of the upper and lower nippers while adapting it to the particular combing job.

A simple possibility for realizing this characteristic consists in providing the guide dog with a guide bolt engaging an arcuately extending guide groove formed in a guide plate. To achieve the desired guide effect it is, of course, necessary to secure the guide plate on the machine frame.

To make possible a free transfer of the pivot movement it has been provided that the free end of the pivot lever has an oblong shot extending parallel to its longitudinal axis which is engaged, with axial play, by a guide body of the shaft connected to the lower nipper carrier. In order to achieve a definite contact pressure between the upper nipper and lower nipper in relation to each other in the closed position it has been provided to dispose the guide dog pivotably around an axis relative to the upper nipper carrier and to provide a spring which is dimensioned in such a way that a quasi rigid angular connection is formed between the end positions during the movement transfer, while in the end position corresponding to the closed position of the nipper arrangement the spring is elastically deflected in order to gain the required closing force.

In an advantageous manner, the spring is in the form of a leaf spring and inserted into slots of the upper nipper carrier or the guide dog. In this manner it is possible to realize the desired spring characteristic in a particularly simple manner.

The spring of the cam drive acting on the lower free end of the pivot lever is preferably in the form of a tension spring, in particular, a helical spring.

In order to achieve simply constructed and yet effective conveying of the fiber tuft, it is provided that a conveying roller is rotatably disposed on the lower nipper carrier, that at least one toothed wheel is disposed connected with the conveying roller secure against rotation and concentric with it, which, during the pivot movement of the lower nipper carrier, cooperates with a fixed toothed segment fastened to the machine frame, and that between the toothed wheel and the conveying roller a free-wheeling device is disposed in a manner known per se, the direction of free-wheeling of which can be chosen such that the free-wheeling effect takes place during the movement in the direction opposite to the conveying movement of the conveying roller. As a freewheeling device in the broadest sense of the word, a toothed ratchet arrangement or the like can also be used.

In another embodiment of the present invention, it is provided that the upper nipper is disposed on the upper nipper carrier linearly pivotable against the force of springs and that in the area of the pivot path of the upper nipper carrier, a cam element with a cam profile is disposed in such a way that a feeler element, connected with the upper nipper lies against the cam profile and that by means of this the upper nipper is moved up and down during its pivot movement.

BRIEF DESCRIPTION OF THE DRAWINGS

Further characteristics, advantages and details of the invention ensue from the following description of two preferred embodiments by means of the drawings, in which.

DETAILED DESCRIPTION OF THE EMBODIMENT

Figure 1:
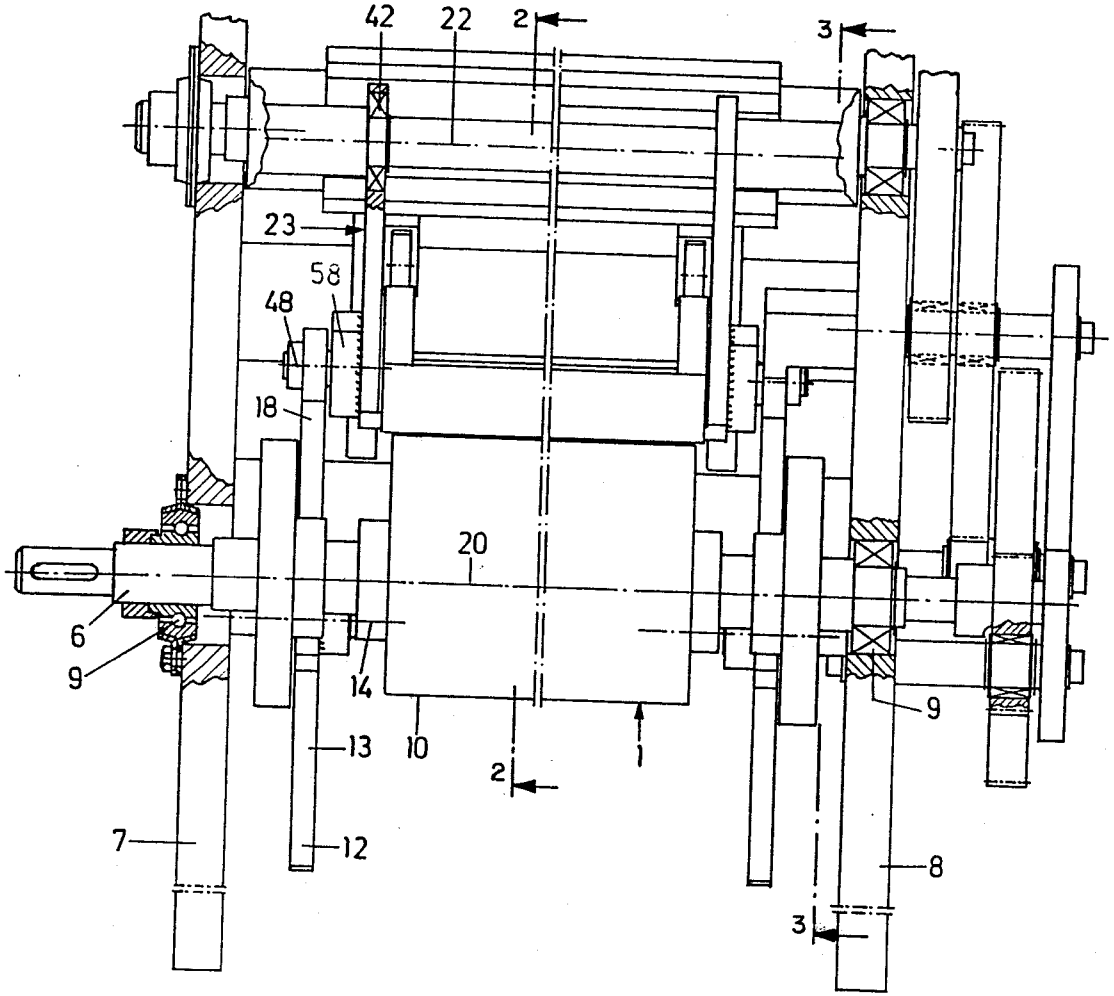
FIG. 1 is a schematic top view of the part essential to the invention of a combing machine in accordance with the invention.

A combing machine shown in the drawings comprises a combing cylinder 1 with a combing segment 2 having a sawtooth device 3, shown only schematically and known from German Patent 30 07 345, as well as a counterweight 4 fastened by means of screws 5 on the foundation of the combing roller 1. The combing roller 1 is rotatably seated via a combing roller shaft 6 by means of roller bearings 9 in the lateral wall 7 and 8 of the combing machine.

A cam disk 10 is seated on the roller shaft 6, having a radius R progressively varying between a maximum radius $R_{max}$ and a minimum radius $R_{min}$.

Acted upon by the force of a tension spring 11, which acts on the end 12 of a first lever arm 13 of a pivot lever 16, pivotably seated on a shaft 14 by means of a roller bearing 15, a feeler wheel 17 lies against the cam disk 10 and is pivotably seated on a shaft 19 on the second lever arm 18 of the pivot lever 16. The pivot lever 16, in cooperation with the feeler wheel 17 and the cam disk 10, is used, as described below, to transfer a driving movement, in coordination with the rotational movement of the combing roller 1, to the nipper mechanism pendulously suspended above the combing roller 1.

Figure 2:
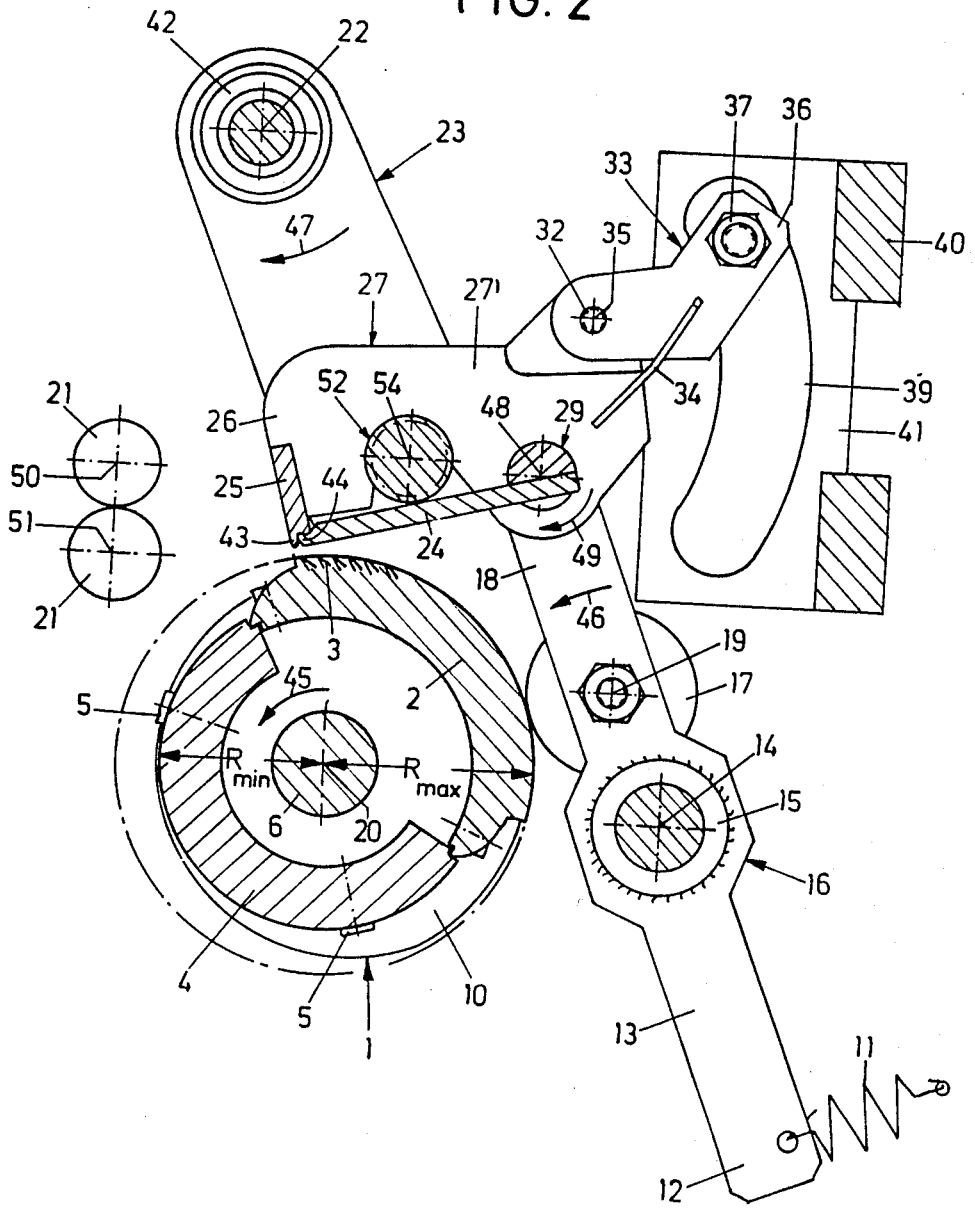
FIG. 2 is a section along the line 2—2 in FIG. 1.
Figure 3:
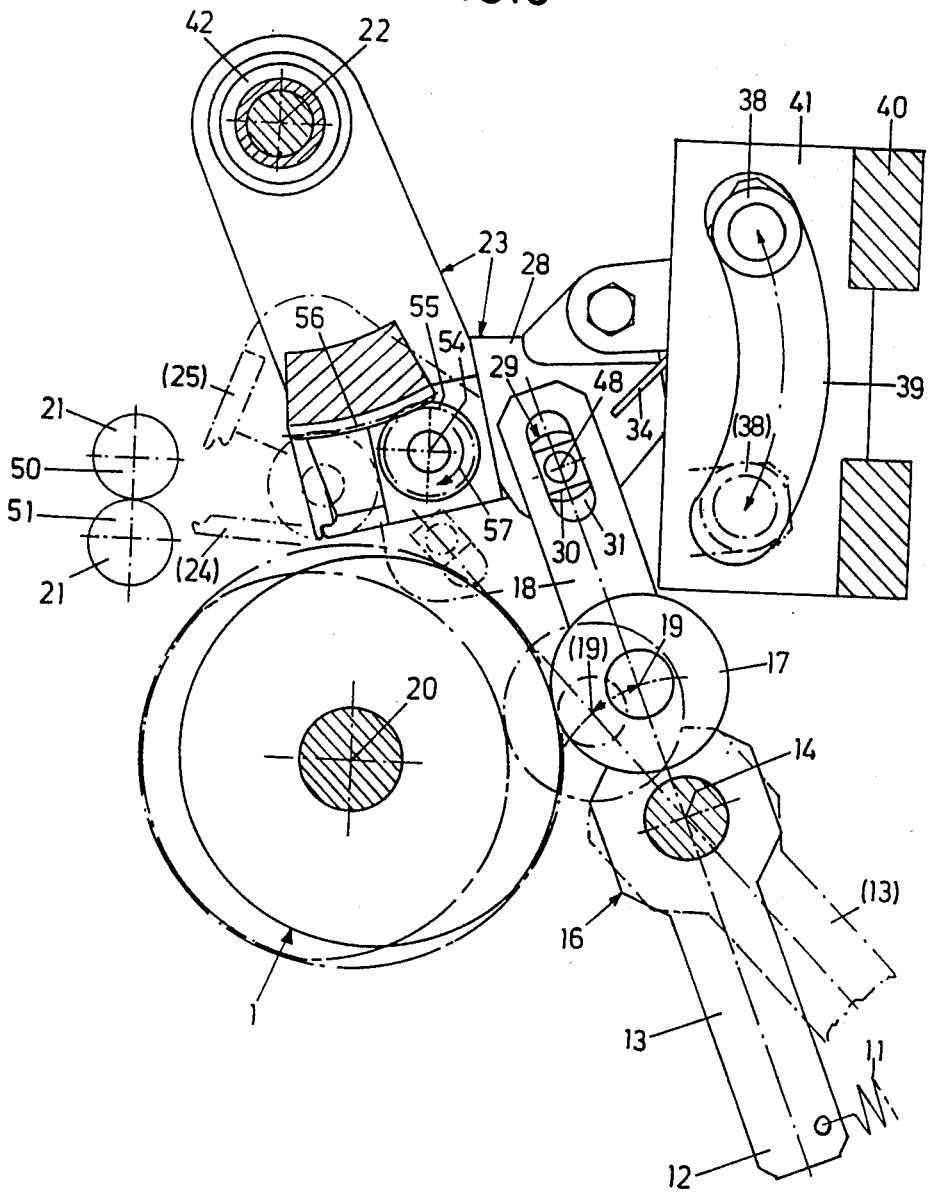
FIG. 3 is a section along the line 3—3 in FIG. 1.

As shown in detail in FIGS. 1 and 2, a lower nipper carrier 23 is pivotably seated on a shaft 22 above the rotating axis 20 of the combing roller 1 in the direction of the draw-off rollers 21, disposed in a customary manner in front of the nipper arrangement. As shown in FIG. 2, the lower nipper 24 is fixed on the lower nipper carrier 23 and, accordingly, can perform a pivot movement around the shaft 22 as shown in FIG. 3.

An upper nipper 25 is fixed on the front end 26 of an upper nipper carrier 27, which is pivotably seated by means of U-shaped arms 27' on a shaft 29 on the lower nipper carrier 23.

The lower nipper carrier 23 is U-shaped in cross section, the lower nipper 24 being fastened and the shaft 29 being pivotably seated in its lateral U-shaped arms 28, the shaft 29 having a sliding dog 30 located outside of one arm 28. This sliding dog 30 engages, in the longitudinal direction with play, a corresponding longitudinal recess 31 on the second lever section 18 of the pivot lever 16. Accordingly, pivoting movement of the pivot lever 16, in particular of the pivot lever section 18, can be transferred to the upper nipper carrier 27.

By means of a shaft 32 a guide dog 33 is disposed at the rear upper end of the upper nipper carrier 27 and is fixed in its angular position relative to the upper nipper carrier 27 by means of a leaf spring 34, which is located tangentially to the pivot axis 35 of the shaft 32 and thus provides a fixed but spring-elastically resilient connection between the guide dog 33 and the lower nipper carrier 23.

On the free outer end 36 of the guide dog 33, a guide pin 38 is fastened by means of a screw 37, which engages a guide recess 39. This guide recess 39 is formed in a guide plate 41, fixedly connected at 40 with the machine housing, and extends in approximately the shape of a segment of a circle around a circle of curvature located somewhat below the pivot axis 35.

It is made clear by the above description that the entire nipper arrangement is pivotably seated around the fixed pivot axes 14, formed by the roller bearing 15, and 22, formed by the roller bearing 42, both located on the machine, and is driven via a cam disk 10 synchronously with the combing roller 1.

In the closed position of the nipper 24 and 25, shown in solid lines in FIGS. 2 and 3, the cam disk 10 lies against the feeler wheel 17 with its maximum radius R and pushes it, together with the pivot lever section 18, into the maximally outermost position shown in FIGS. 2 and 3, the upper nipper carrier 27 with the upper nipper 25 being pivoted via the shaft 29 and the guide dog 33 or the guide recess 39 relative to the lower nipper 24 or the lower nipper carrier 23.

In the end position shown, corresponding to the closed position of the nippers 24, 25, the front edge 43 of the upper nipper 25, or 44 of the lower nipper 24, contact each other under pressure, the contact pressure being generated by the leaf spring 34 being deformed beyond the contact position of the edges 43 and 44. A secure positioning of the fiber tuft is attained by means of this pressure.

When the combing roller shaft 6 continues to turn in the direction of the arrow 45 and the cam disk 10 correspondingly continues to turn, the area of the minimum radius $R_{min}$ comes into contact with the feeler wheel 17, which is pressed against the cam disk 10 by means of the tension spring 11. Because of this the pivot lever 16 and with it the pivot section 18 is pivoted in the direction of the arrow 46. In this way, the lower nipper carrier 23 is pivoted around the pivot axis 22 in the direction of the arrow 47 to the left in FIG. 2, so that the lower nipper 24 performs an upward movement in the direction towards the draw-off rollers 21. Simultaneously, the upper nipper carrier 27 is pivoted forward and upward around the pivot axis 48 formed by the shaft 29 in the direction of the arrow 49, so that the nipper 24, 25 takes up the opened position, shown in dashed lines in FIG. 3, in front of the draw-off rollers 21, and the fiber tuft which was between the closed nipper 24, 25 and is not shown in the drawings, is conveyed to the draw-off rollers 21, so that the latter can have, in a particularly advantageous manner, fixed rotational axes 50, 51 and are themselves not required to be moved synchronously with the combing roller in the direction of the nipper arrangement.

A transport roller 52 is rotatably seated around a rotational axis 54 on the upper nipper carrier 27. In the course of the pivot movement of the upper nipper carrier 27 in the direction of the arrow 49, the rotational axis 54 of this transport roller 52 is being displaced correspondingly. Because of this, a toothed wheel 55 disposed on the outermost end of the transport roller 52 is moved, as shown in FIG. 3, along a toothed segment 56 fixed on the machine frame, and is correspondingly rotatingly driven in the direction of the arrow 57. A free-wheeling device 58 is disposed between the toothed wheel 55 and the transport roller 52 and sees to it that the transport roller 52 is not driven in a direction opposite to that of the arrow 57 when the nipper moves back into the closed position. In this manner, it is possible to derive the drive of the transport roller 52, which accomplishes the further transport of the combed part of the fiber tuft, also without problems from the rotation of the main shaft 6 of the combing roller 1.

Figure 5:
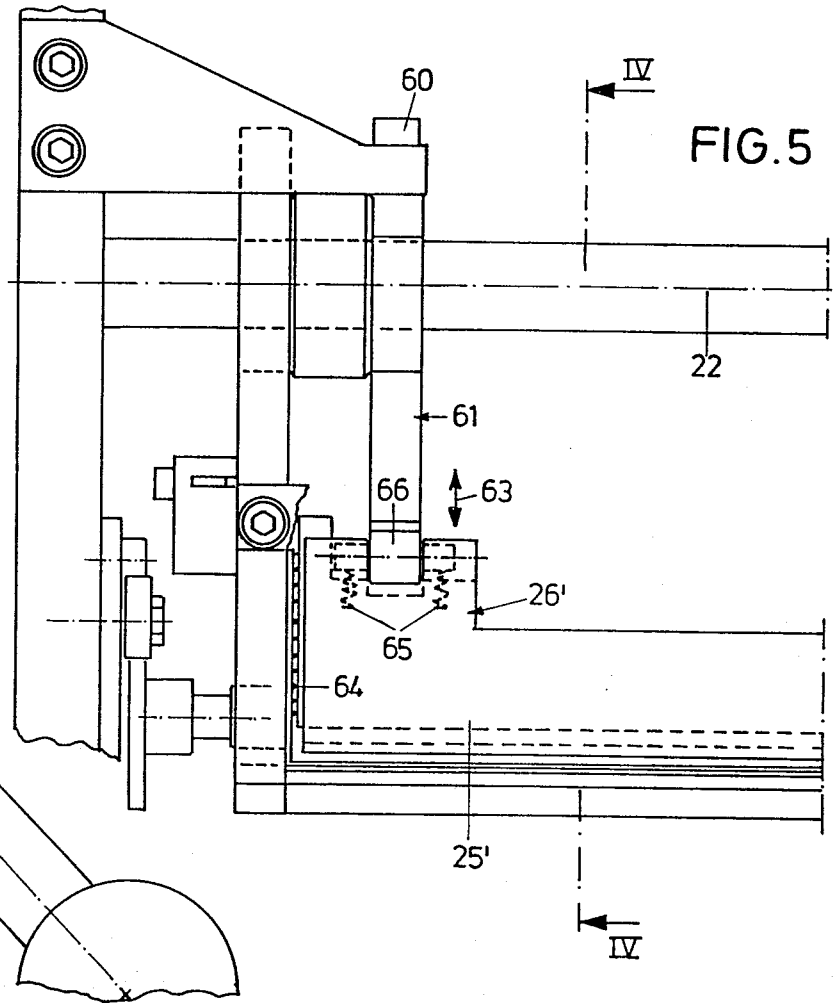
FIG. 5 is an illustration of the changed embodiment corresponding to FIG. 1.
Figure 4:
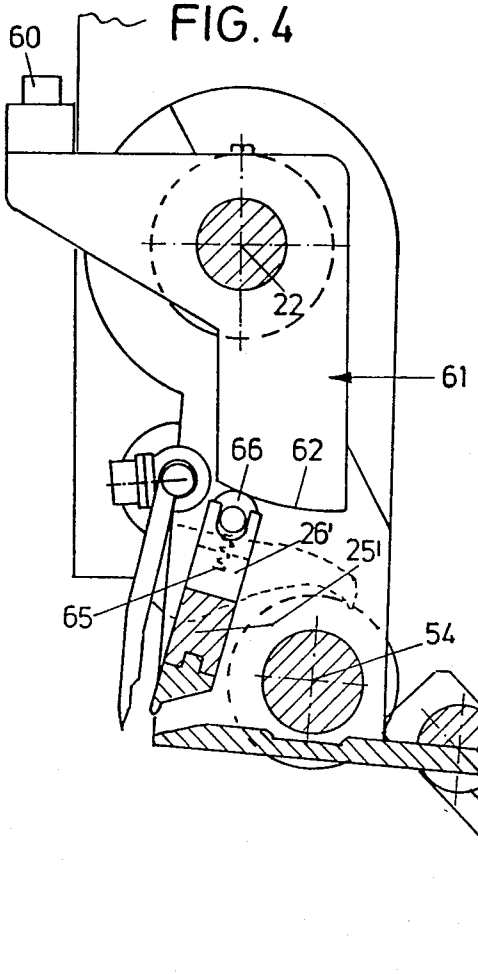
FIG. 4 is an illustration of a changed embodiment corresponding to FIG. 2.

In the embodiment shown in FIGS. 4 and 5, the entire construction is the same as described above in connection with FIGS. 1 to 3. Only the guide dog 33 and the guide recess 39 and their associated parts are omitted.

Instead of the guide recess 39, a cam element 61 is fixed by means of a cam profile 62 on both sides of the upper nipper 25'. The upper nipper 25' is seated linearly upwardly and downwardly movable in the direction of the arrow 63 on an upper nipper carrier 26' by means of linear ball bearings 64. Helical springs 65, supported on the upper nipper carrier 26', press the upper nipper 25' upwardly, so that a feeler member 66, connected with the upper nipper 25', is pressed against the cam profile 62.

As described in connection with FIGS. 1 to 3, the upper nipper carrier 26' is pivotably driven. In the course of performing such a pivot movement, departing from a left end position shown in FIG. 4, corresponding to an opened position of the nipper arrangement, the upper nipper 25' is pressed downwardly into a closed position by the cam profile 62 during pivoting (to the right in FIG. 4). In the course of the return pivoting movement, the upper nipper 25' is returned again into the opened position by means of the springs 65.

The foregoing description of the specific embodiments will so fully reveal the general nature of the invention that other can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A combing machine, in particular for combing of cotton, comprising a combing roller with at least one combing segment;

conveyance means for the fiber tuft to be combed;

an upper and lower nipper for fixing the fiber tuft during engagement of the combing segment, the upper and lower nipper being pivotably disposed in a forward and backward direction around an axis disposed above a comb cylinder;

cam drive means for the combing roller and for directly driving the pivoting movement of the upper and lower nipper;

the cam drive means including a cam disk, a spring-loaded pivot lever, and a rotatably disposed feeler wheel supported by the pivot lever;

a lower nipper carrier which is pivotably seated around an axis ahead of and above the rotational axis of the combing roller and is acted upon by a free end of the pivot lever; and a shaft connected with the lower nipper carrier and including a sliding dog, wherein the free end of the pivot lever has a longitudinal slot extending parallel to a longitudinal axis of the pivot lever, which is engaged with longitudinal play by the sliding dog.

2. A combing machine, in particular for combing of cotton, comprising a combing roller with at least one combing segment;

conveyance means for the fiber tuft to be combed;

an upper and lower nipper for fixing the fiber tuft during engagement of the combing segment, the upper and lower nipper being pivotably disposed in a forward and backward direction around an axis disposed above a comb cylinder;

cam drive means for the combing roller and for directly driving the pivoting movement of the upper and lower nipper;

the cam drive means including a cam disk, a spring-loaded pivot lever, and a rotatably disposed feeler wheel supported by the pivot lever;

a lower nipper carrier which is pivotably seated around an axis ahead of and above the rotational axis of the combing roller and is acted upon by a free end of the pivot lever;

an upper carrier on which the upper nipper is fixed and which is pivotably seated on a pivot bearing on the lower nipper carrier;

a guide dog connected with the upper nipper carrier, which is guided by means of a cam guide;

the guide dog seated pivotably around an axis in relation to the upper nipper carrier and a spring disposed between the guide dog and the upper nipper, the spring being of such a size that in the course of the transfer of the movement a quasi rigid angular connection is made between end positions of the guide pin, while in the end position corresponding to the closed position of the nipper arrangement, and the spring being elastically deformed in order to attain the required closing force;

the spring including a leaf spring and inserted into slots of the upper nipper carrier or of the guide dog.

3. A combing machine, in particular for combing of cotton, comprising a combing roller with at least one combing segment;

conveyance means for the fiber tuft to be combed;

an upper and lower nipper for fixing the fiber tuft during engagement of the combing segment, the upper and lower nipper being pivotably disposed in a forward and backward direction around an axis disposed above a comb cylinder;

cam drive means for the combing roller and for directly driving the pivoting movement of the upper and lower nipper;

the cam drive means including a cam disk, a spring-loaded pivot lever, and a rotatably disposed feeler wheel supported by the pivot lever;

the cam drive means including a spring in the form of a tension spring acting on a lower free end of the pivot lever.

4. A combing machine, in particular for combing of cotton, comprising a combing roller with at least one combing segment;

conveyance means for the fiber tuft to be combed;

an upper and lower nipper for fixing the fiber tuft during engagement of the combing segement, the upper and lower nipper being pivotably disposed in a forward and backward direction around an axis disposed above a comb cylinder;

cam drive means for the combing roller and for directly driving the pivoting movement of the upper and lower nipper;

the cam drive means including a cam disk, a spring-loaded pivot lever, and a rotatably disposed feeler wheel supported by the pivot lever;

a lower nipper carrier which is pivotably seated around an axis ahead of and above the rotational axis of the combing roller and is acted upon by a free end of the pivot lever;

an upper carrier on which the upper nipper is fixed and which is pivotably seated on a pivot bearing on the lower nipper carrier;

the upper nipper disposed on the upper nipper carrier linearly displaceable against the force of springs and further including a cam element seated in the area of the pivot path of the upper nipper carrier, the cam element having a cam profile, in such a way that a feeler element connected with the upper nipper rests against the cam profile and in this manner in the course of its pivoting movement the upper nipper is moved upwardly and downwardly.

* * * * *